US007846493B1

(12) United States Patent
Cox

(10) Patent No.: US 7,846,493 B1
(45) Date of Patent: Dec. 7, 2010

(54) SPRAYING OF FIBERS FROM A CONTAINER THAT INCLUDES AN AGITATOR

(75) Inventor: Anthony Cox, Kowloon (HK)

(73) Assignee: Dynasty Foorwear, Ltd., El Segundo, CA (US)

( * ) Notice: Subject to any disclaimer, the term of this patent is extended or adjusted under 35 U.S.C. 154(b) by 529 days.

(21) Appl. No.: 11/866,289

(22) Filed: Oct. 2, 2007

Related U.S. Application Data

(60) Provisional application No. 60/827,880, filed on Oct. 2, 2006.

(51) Int. Cl.
*B05D 1/14* (2006.01)

(52) U.S. Cl. ..... 427/200; 427/206; 427/462

(58) Field of Classification Search ..... 427/200, 427/206, 462
See application file for complete search history.

(56) References Cited

U.S. PATENT DOCUMENTS

| | | | | |
|---|---|---|---|---|
| 2,550,354 | A * | 4/1951 | Jacobsen | 406/65 |
| 2,850,214 | A | 9/1958 | Rooney, Jr. | |
| 4,345,702 | A | 8/1982 | Wolfe | |
| 4,963,392 | A * | 10/1990 | Molnar et al. | 427/180 |
| 5,173,325 | A * | 12/1992 | Knobbe et al. | 427/476 |
| 5,928,731 | A * | 7/1999 | Yanagida et al. | 427/475 |
| 6,913,784 | B2 | 7/2005 | Xue et al. | |
| 7,516,506 | B2 * | 4/2009 | Koo et al. | 12/146 B |
| 2003/0175417 | A1 * | 9/2003 | Trevisan | 427/180 |
| 2004/0091784 | A1 | 5/2004 | Frederiksson et al. | |
| 2004/0194345 | A1 * | 10/2004 | Koo | 36/59 C |

FOREIGN PATENT DOCUMENTS

| | | |
|---|---|---|
| GB | 0886222 | 1/1962 |
| GB | 1443331 | 7/1976 |
| JP | 62071695 | 4/1987 |
| WO | WO01/26863 | 4/2001 |
| WO | WO2004042847 | 5/2004 |

* cited by examiner

*Primary Examiner*—Frederick J Parker
(74) *Attorney, Agent, or Firm*—Joseph G. Swan, P.C.

(57) ABSTRACT

Provided are methods and techniques for a spraying fibers. A container having an agitator or a blade assembly in its bottom section is obtained and then partially filled with fibers, so as to at least partially cover the agitator or blade assembly. The agitator or blade assembly is operated with the container substantially closed, thereby causing a plurality of the fibers to become airborne within the container, and then an airflow is created to draw the airborne fibers out of the container. Finally, the airborne fibers that have been drawn out of the container are directed into a desired spray, using a sprayer.

19 Claims, 4 Drawing Sheets

SPRAYING OF FIBERS FROM A CONTAINER THAT INCLUDES AN AGITATOR

This application claims the benefit of U.S. Provisional Patent Application Ser. No. 60/827,880, filed on Oct. 2, 2006, and titled "Particle Spraying Methods and Apparatuses", which application is incorporated by reference herein as though set forth herein in full.

FIELD OF THE INVENTION

The present invention pertains to particle spraying, e.g., for the purpose of applying a coating of particles (such as short fibers) to an article of manufacture.

BACKGROUND

A variety of different techniques for spraying particles exist. However, each such technique has its own drawbacks. For example, many of the conventional techniques require specialized equipment to implement, are difficult to control and/or would not provide good results, e.g., for certain manufacturing applications.

SUMMARY OF THE INVENTION

The present invention addresses these problems by first using an agitation device, rotating blade assembly or another mechanism for causing particles within a substantially closed container to become airborne, and then drawing out such airborne particles and directing them into a spray.

Thus, one embodiment of the invention is directed to a method of spraying particles, by obtaining a container having an agitator in its bottom section and then partially filling the container with particles so as to at least partially cover the agitator. The agitator is operated with the container substantially closed, thereby causing a plurality of the particles to become airborne within the container, and then an airflow is created to draw the airborne particles out of the container. Finally, the airborne particles that have been drawn out of the container are directed into a desired spray, using a sprayer.

By virtue of the foregoing arrangement, a good airborne mixture of particles often can be achieved, resulting in a better quality spray than is possible with the most conventional techniques. At the same time, it often is possible to better control parameters of the spray. For example, by controlling the speed and/or other parameters of the agitation, it is often possible to directly affect, e.g., the concentration of airborne particles. By controlling the speed at which the air-particle mixture is withdrawn from the container, it is often possible to directly affect the quantity of particles sprayed and/or their orientations.

Another embodiment of the invention is directed to a method of spraying particles, by obtaining a container having a blade assembly in its bottom section and then partially filling the container with particles so as to at least partially cover the blade assembly. The blade assembly is rotated with the container substantially closed, thereby causing a plurality of the particles to become airborne within the container, and then an airflow is created to draw the airborne particles out of the container. Finally, the airborne particles that have been drawn out of the container are directed into a desired spray, using a sprayer.

The foregoing summary is intended merely to provide a brief description of certain aspects of the invention. A more complete understanding of the invention can be obtained by referring to the claims and the following detailed description of the preferred embodiments in connection with the accompanying figures.

BRIEF DESCRIPTION OF THE DRAWINGS

In the following disclosure, the invention is described with reference to the attached drawings. However, it should be understood that the drawings merely depict certain representative and/or exemplary embodiments and features of the present invention and are not intended to limit the scope of the invention in any manner. The following is a brief description of each of the attached drawings.

DESCRIPTION OF THE PREFERRED EMBODIMENT(S)

This application is related to U.S. Patent Application Ser. No. 60/803,351 titled, "Sheet Material with Embedded Fibers or Fabric Material" and (the '351 application), U.S. patent application Ser. No. 11/751,581 titled, "Shoe Outsole Made Using Composite Sheet Material" (the '581 application), now U.S. Pat. No. 7,516,506, U.S. patent application Ser. No. 10/613,741 titled, "Shoe Having a Contoured Bottom with Small Particles Bonded to the Lowest Extending Portions Thereof" (the '741 application), and U.S. patent application Ser. No. 11/530,419 titled, "Alternating Bonded Particles and Protrusions" (the '419 application), which applications are incorporated by reference herein as though set forth herein in full.

Generally speaking, the present invention pertains to methods and apparatuses for spraying particles. In the preferred embodiments, the resulting particle sprays are used for coating the bottom surface of a shoe's outsole or for coating a sheet material that subsequently is cut into (i.e., so as to form) a shoe's outsole. In the preferred embodiments, the general sequence is to partially fill a container with desired particles (e.g., short natural fibers or other natural particles), create agitation within the container to maintain a quantity of the particles airborne, and create an airflow that draws the airborne particles out of the container and directs them into a desired spray. In certain embodiments where the particles are fibers, the fibers preferably are less than approximately 5 millimeters (mm) in length, or even as short as approximately 0.1 mm in length, but, more preferably, are approximately 1-2 mm in length.

Figure 1:
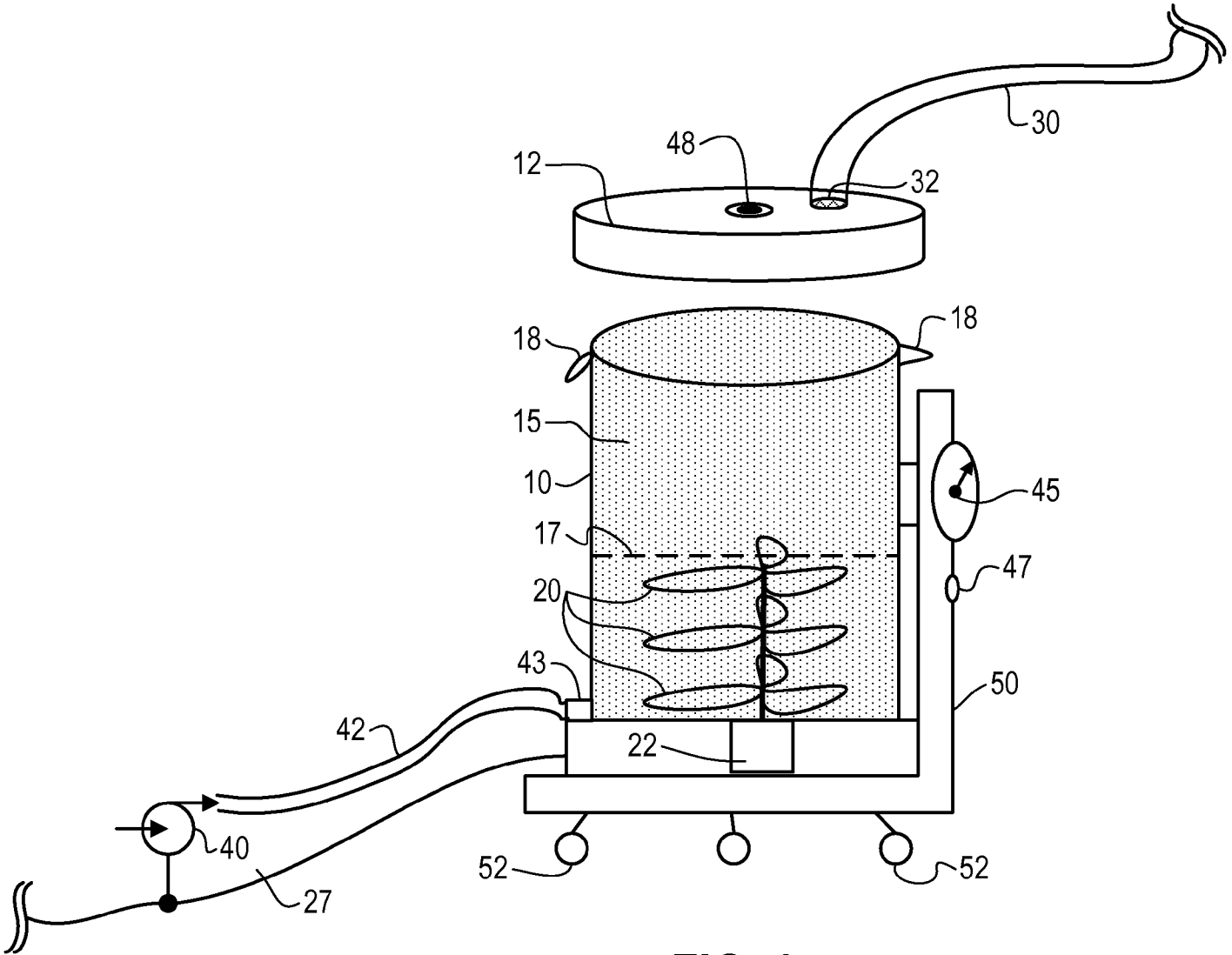
FIG. 1 is a conceptual view of a container assembly for use in spraying particles according to a representative embodiment of the present invention.
Figure 2:
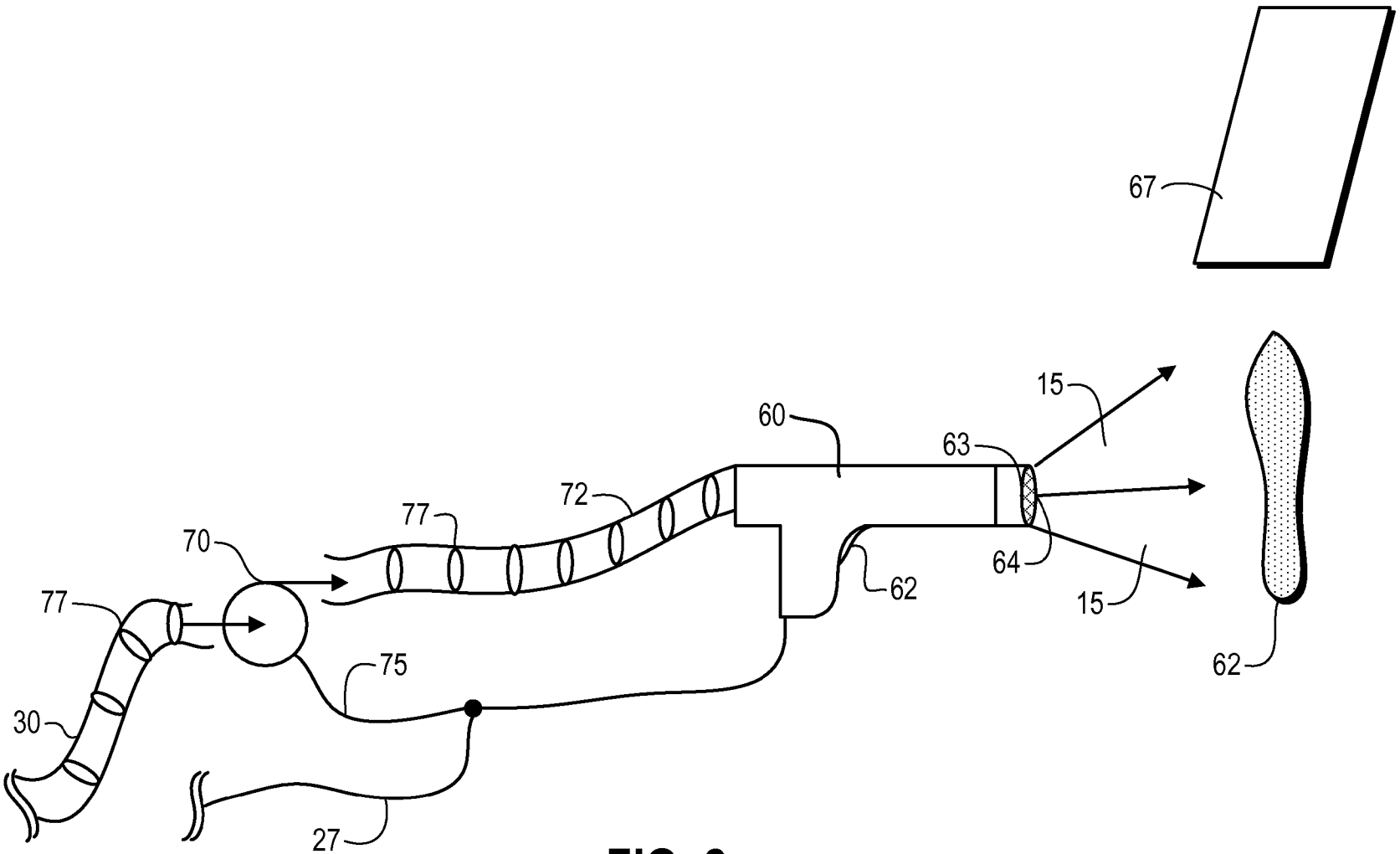
FIG. 2 is a conceptual view of a hose and spray gun assembly.

A representative embodiment of a system according to the present invention is shown in FIGS. 1 and 2. Specifically, FIG. 1 shows a container 10 having a removable cover 12. For example, container 10 may be cylindrically shaped, having a diameter of 1-3 feet and a depth of 1-5 feet. In use, cover 12 is removed from container 10, and a desired quantity of particles 15 (preferably dry particles) are poured into container 10. Upon settling (i.e., when the particles 15 are at rest), the particles 15 fill container 10 up to a level 17. After filling container 10 to the desired level 17, cover 12 is placed on top of container 10 and secured with hooks 18 that ensure a good seal between cover 12 and container 10, creating a relatively airtight chamber within container 10.

As shown in FIG. 1, container 10 also includes a blade assembly 20 which is driven by a motor 22 so that it rotates around a central post 24. An external wire 27 allows a user to control when the motor 22 is operated. In the present embodiment, blade assembly 20 is configured as three coaxial fans. However, in alternate embodiments any other number of fans and/or any other configuration may be used. When activated, assembly 20 creates upwardly directed airflow, thereby pushing the particles away from the bottom of container 10 where they otherwise would naturally tend to settle, and causing them to become airborne.

It is noted that the individual blades making up blade assembly 20 may be in various sizes, shapes and/or degrees of sharpness or bluntness, depending upon the desired effect and/or depending upon the size, density, thickness and/or physical makeup of the particles. For example, using sharp blades can result in cutting the particles as they are being agitated, thereby resulting in smaller and/or more uniform particle sizes.

Also, the speed of the blade assembly preferably is controlled based on any or all of these same considerations. For example, for smaller and/or low-density particles that tend to fall at a fairly slow speed (e.g., drift downwardly) in an ambient air environment, such as fabric fibers, the motor 22 preferably is operated at a slow speed (e.g., no faster than 40-120 revolutions per minute). On the other hand, for larger and/or denser particles that tend to fall in an ambient air environment at a faster speed (e.g., where air resistance is not as significant a factor), such as rubber, synthetic rubber or leather, the motor 22 preferably is operated at a higher-speed, both to generate enough power to propel the typically heavier particles up into the air and also to continually throw a larger number of particles upwardly (making up for the faster rate at which the particles are falling back down, so that the overall effect somewhat resembles a popcorn maker).

In other words, the present embodiment uses a fan or fan-like assembly to push particles upwardly, with gravity naturally tending to pull them back downwardly. The result is a circulation effect that tends to ensure that at least some of the particles remain airborne on a continual basis, provided the fan assembly is operating. However, the invention is not limited to the particular mechanism described above.

For example, any configuration to cause the particles or be substantially evenly, uniformly or randomly dispersed within an ambient air environment instead could be used. One alternate approach is to use a conveyor belt mechanism in place of blade assembly 20, with the belt itself having ridges and/or paddles on its outer surface, thereby lifting or propelling the particles 15 upwardly within the container 10, and with gravity causing the particles to then drift or fall back down, again creating the circulation effect described above.

Still further, rather than maintaining the particle reservoir at the bottom of container 10, a particle reservoir, e.g., with a mesh bottom, can be maintained at the top of container 10; in such an embodiment, vibration may be used to cause the particles to fall through the mesh and a pump may be provided to return the particles that have settled onto the bottom of the container 10 back up to the reservoir. However, the fan approach described above currently is preferred by virtue of its simplicity and ease of maintenance.

In any event, once an internal atmosphere having the desired concentration of airborne particles has been established, in the present embodiment a detachable air suction hose 30 is used to draw the particles out of container 10. In the preferred embodiments, a mesh filter 32 is disposed between hose 30 and container 10 in order to prevent clumps of fibers from being drawn into hose 30. Alternatively, a rotating blade structure or similar mechanism can be used to break up any such large clumps before the particles are drawn into hose 30.

A separate pump 40 provides positive air pressure via hose 42, which is coupled to an air intake 43 on container 10, thereby replacing the air withdrawn through hose 30. A pressure gauge 45 indicates the pressure within container 10 and control 47 allows a user to adjust the amount of air pressure (by controlling pump 40 and/or by functioning as a regulator) to within acceptable levels, preferably just a couple of pounds per square inch (although higher pressures instead may be used). In addition, a safety cap 48 (preferably provided with a pressure release valve that triggers at a specified pressure) prevents excess pressure buildup. Alternatively, pump 40 even could be set to neutral or omitted entirely, e.g., with replacement air being drawn in through a provided intake valve 43 as a result of the pressure differential caused by the suctioning from hose 30. In any event, although shown as being on the bottom of container 10, it is noted that air intake 43 instead may be located anywhere else on container 10; also, there may be more than one such intake 43.

It is noted that the placement of air intake 43 relative to vacuum hose 30 on container 10 can be adjusted to achieve different desired effects and/or based on different particle properties. Ordinarily, with air intake 43 on the opposite side of the vacuum hose 30 an air stream will be created through the entire interior of container 10. The speed of the airflow within this stream (and thus the volume of the air-particle mixture that is drawn into hose 30) depends at least in part on the pressure differential between those two points. On the other hand, if air intake 43 and hose 30 are located nearby each other within container 10, then a smaller quantity of air-particle mixture ordinarily will be drawn in by the same pressure differential, it may be easier to more precisely control the quantity of such mixture that is drawn in, and the space within which the desired air-particle mixture needs to be maintained typically will be smaller. In one such example, both air intake 43 and the air outlet where hose 30 attaches both are located in the cover 12. As noted above, container 10 can be provided with more than one air intake 43; similarly, it can be provided with more than one air outlet. In certain embodiments, multiple ones of such intakes and/or outlets are used at the same time (e.g., to create a desired air flow pattern), while in other embodiments only one of each is used, with the particular ones selected depending upon the effect to be achieved and/or the nature of the particles (e.g., in terms of size, shape and/or density).

The entire apparatus preferably is supported by a cart 50 having wheels 52. The use of such a cart 50 facilitates movement of the apparatus to production lines or other locations where the apparatus is to be used.

FIG. 2 illustrates a spray gun 60 for projecting airborne fibers onto a desired substrate or surface. In the preferred embodiments, sprayer 60 is used for applying particles 15 to the outsole of a shoe. As a result, a pre-cut outsole 62 may be coated with adhesive material and then sprayed with particles 15. Alternatively, a sheet of material 67 may be coated with adhesive material, sprayed with particles 15, and then cut into shoe outsoles, or into any other desired shape for that matter. In either event, the spraying may be done in a box to reduce dust or stray particles if the spray is at high pressure. Alternatively, typically if the spray is at lower pressures, the spraying may be done in an open area.

In either event, but particularly when spraying into a box or other enclosure, a vacuum device may be used to collect the stray particles that do not adhere to the adhesive-coated surface, thereby allowing the user to more accurately direct the spray and providing a cleaner working surface. In one particular embodiment, the same vacuum device is used to pump the collected particles back into the container 10 (e.g., by maintaining an airflow from the collection/work site directly back into the container 10. It is noted that such a vacuum device can even be implemented using pump 40, with hose 42 then providing not only positive air pressure, but the recycled particles as well.

For these purposes, an air pump 70 is used to draw the air-particle mixture from container 10 through hose 30, and then through hose 72 and spraying gun (or sprayer) 60. A trigger switch 62 preferably is attached via electrical line 75 to pump 70 and via electrical line 27 to motor 22 and pump 40, thereby simultaneously controlling the operation of all three. Alternatively, any or all of pump 70, motor 22 and pump 40 may be operated continuously or separately controlled. In one example, switch 62 operates a valve that controls when the air-particle mixture is projected from gun 60. It is also noted that the number and types of pumps referenced herein are exemplary only, and any other numbers and/or kinds of pumps instead may be used.

Spray gun 60 may be made of any of a variety of materials, but preferably has a main body that is made from a metal or polyvinyl chloride (PVC) pipe. In the preferred embodiments, spray gun 60 terminates in a removable end cap 63 that includes a mesh filter 64, with the size of the grid pitch for filter 64 depending upon how the fibers or other particles are to be disbursed, with wider pitches for thicker coverings and smaller pitches for thinner disbursement. Use of a removable cap 63 facilitates maintenance by allowing fiber accumulation to be easily and quickly removed.

In the preferred embodiments, hoses 30 and 72 are capable of withstanding the levels of air pressure produced by pump 70. Thus, in one embodiment hoses 30 and 72 are standard vacuum hoses that incorporate rigid shape-retaining rings 77. Ordinary hose clamps may be used to attach hoses 30 and 72 to pump 70 and spray gun 60.

It is noted that any excess particles 15 that do not adhere to the intended substrate (e.g., outsoles 62 or sheet material 64) may be simply collected and poured back into container 10 for reuse or, as noted above, automatically recycled, e.g., using an airflow system that provides a vacuum effect at the worksite and then blows the collected particles back into the container 10.

Although the embodiment described above uses a combination of positive pressure applied into the container 10 and negative pressure to draw the air-particle mixture out of the container 10, any other pressurized system for moving the air-particle mixture from container 10 to spray gun 60 instead may be used. In one embodiment, positive pressure applied to the container 10 alone is used to push the air-particle mixture through a one-way valve to the spray gun 60. In another embodiment, the same air pressure that is used to agitate the particles (keeping them airborne) also is used to push the air-particle mixture to the spray gun 60.

Figure 3:
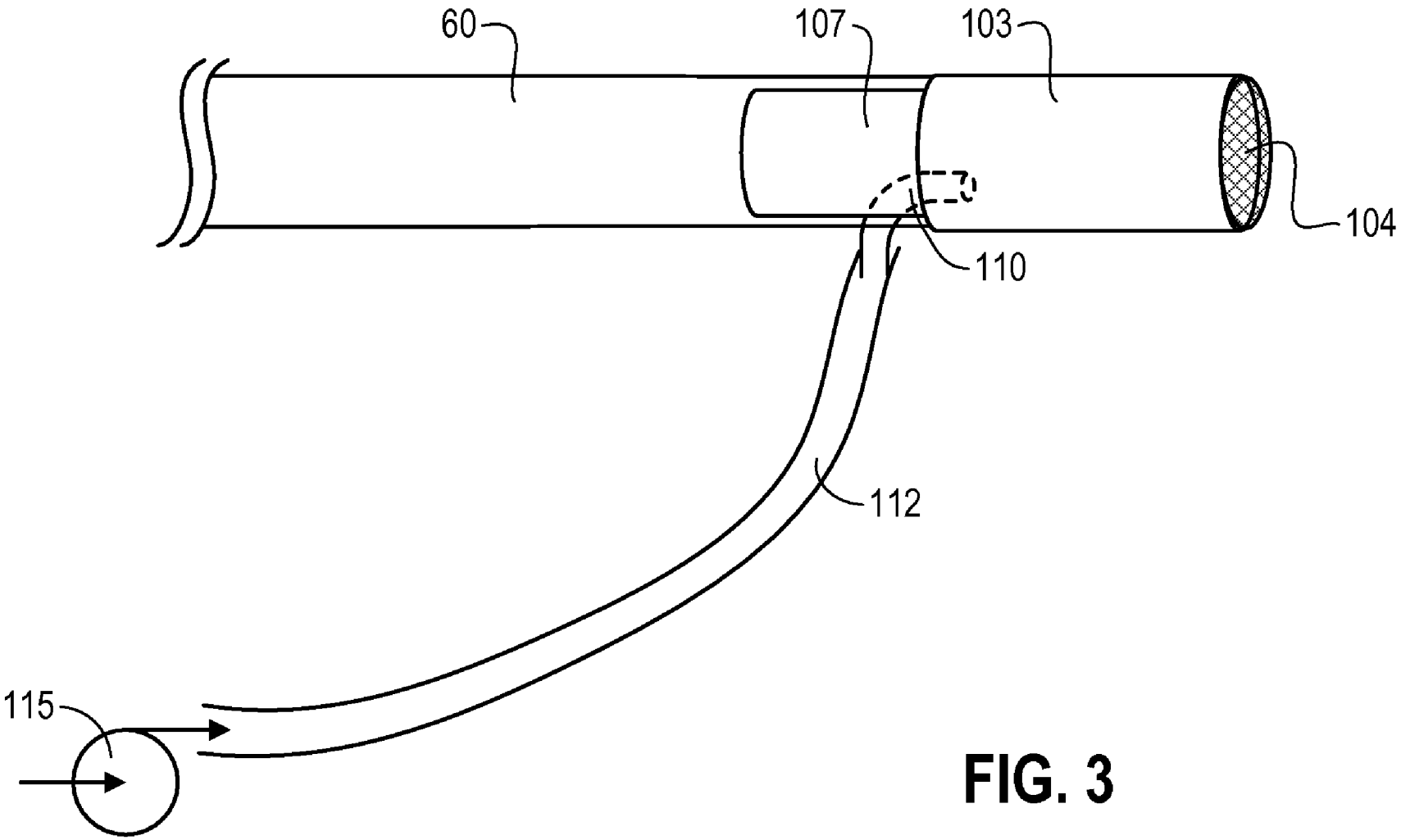
FIG. 3 is a conceptual view of a spray gun nozzle assembly according to an alternate embodiment of the invention.

An alternate end cap 103 that can be used in place of end cap 63 (shown in FIG. 2) is illustrated in FIG. 3. End cap 103 is provided with a mesh filter 104 which is similar to mesh filter 64 used in end cap 63. However, unlike cap 63, end cap 103 is provided with an additional air tip 110 which conducts airflow from outside of end cap 103 into its interior and directs it toward the front of end cap 103. More preferably, air tip 110 is rigid and is built into the neck of removable end cap 103. Connected to air tip 110 through hose 112 is a high-pressure air pump 115, which creates an air jet at significantly higher pressure than the air otherwise exiting from spray gun 60. The additional air pressure provided through tip 110 often can create a more focused and intense particle spray. In the present embodiment, switch 62 preferably also controls the operation of air pump 115. Also, in the present embodiment end cap 103 includes a tapered portion 107 at its proximal end for fitting into the distal end of spray gun 60.

The additional pressure provided by pump 115 preferably is adequate to drive the particles deeply into the adhesive layer of the surface (or substrate) to be coated. Alternatively, in other embodiments other approaches are used to create such a high-pressure airflow stream at the nozzle of spray gun 60. Examples include using high-pressure pumps for either or both of pumps 40 and 70 and/or tapering cap 63 or 103 so as to have a small-diameter tip relative to hose 72 and/or hose 30.

Figure 4:
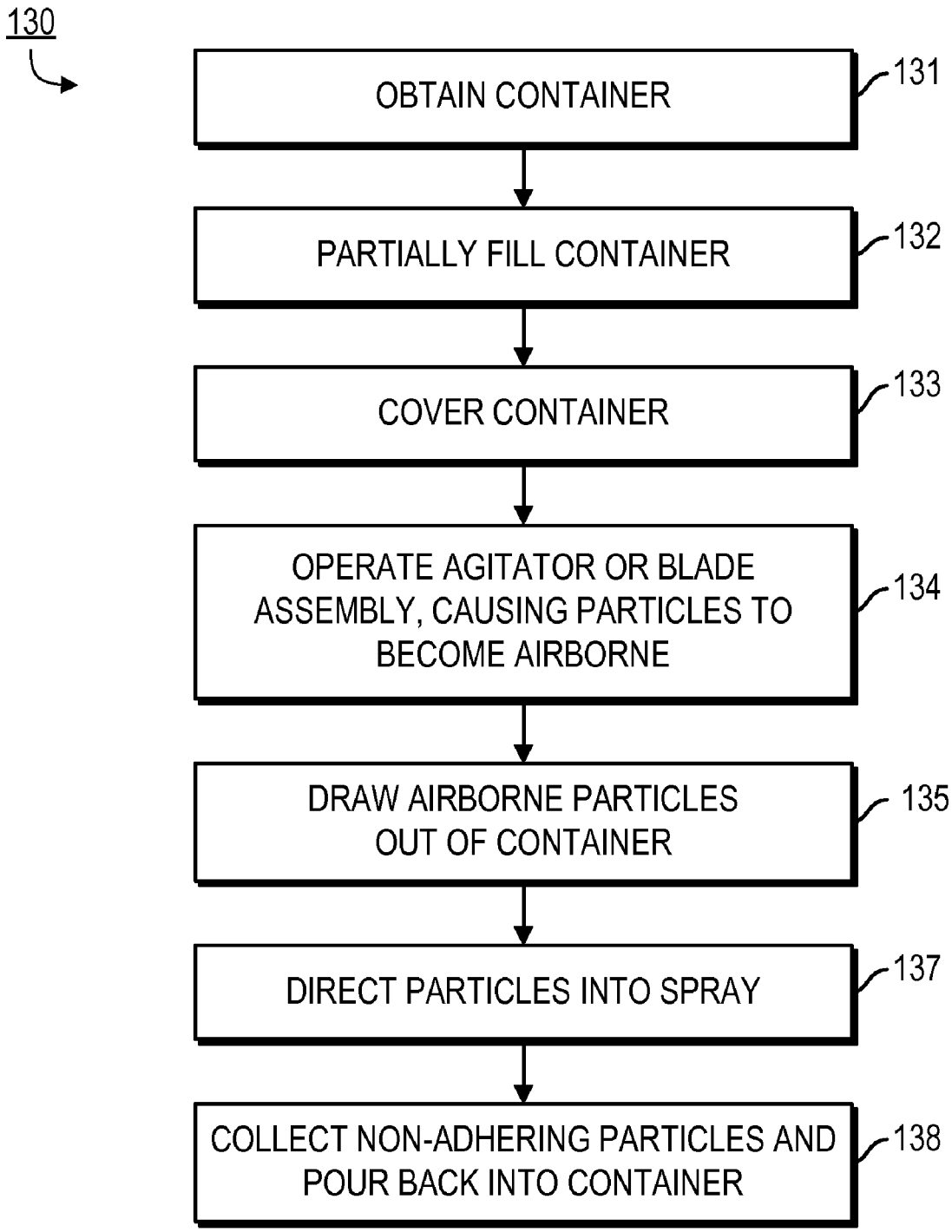
FIG. 4 is a flow diagram illustrating a particle-spraying technique according to the present invention.

FIG. 4 is a flow diagram illustrating a method 130 for using a system, such as the system shown in FIGS. 1-3, according to representative embodiment of the present invention. Initially, in step 131 a container (e.g., container 10) is obtained. As noted above, container 10 preferably has an agitator or rotatable blade assembly (e.g., blade assembly 20) in its bottom section. While a rotatable assembly is preferred for its ease of implementation, any other kind of agitation mechanism may be used to cause at least some of the particles to become airborne, e.g., including mechanisms that use any combination of vibration, pivoting, up-and-down motion (e.g., such as a piston operation) and/or rotation.

In step 132, the container is partially filled with particles, preferably to a level so as to at least partially cover the agitator or rotatable blade assembly, e.g., as shown by level 17 in FIG. 1. More preferably, the agitator or rotatable blade assembly is completely submerged beneath the particles when the particles are at rest.

In step 133, the container is covered, preferably creating a substantially airtight chamber within the container.

In step 134, the agitator or rotatable blade assembly is operated, causing at least some of the particles to become airborne within the container.

In step 135, the airborne particles are drawn out of the container, preferably by creating an airflow (e.g., using a suction hose). Alternatively, or in addition, the particles may be pushed out through the use of positive air pressure (e.g., as provided by pump 40).

In step 137, the airborne particles that have been drawn out of the container into a desired spray, e.g., using a spray gun or other kind of sprayer. In the preferred embodiment, the particle spray is directed toward an adhesive-coated surface, such as a shoe outsole cutout or a sheet of material that subsequently is cut into a shoe outsole.

In step 138, the non-adhering particles are collected and poured back into the container for reuse.

As noted above, the particles within the container can be agitated only when they are desired to be withdrawn from the container. Alternatively, the particles can be maintained in a state of agitation at other times as well, e.g., so that a significant number remain airborne and ready to be withdrawn from the container when desired. In any event, a significant quantity of the particles preferably are maintained airborne during the entire spraying process or whenever spraying is desired.

The embodiments described above primarily pertain to a relatively small spraying system, e.g., for use in a factory or other fixed-location manufacturing setting. In addition, it is noted that a spraying system according to the present invention might be significantly larger (e.g., truck-mounted or trailer-mounted), used for large-scale spraying operations and/or used for on-site spraying operations. Examples include embedding particles into an asphalt road before the asphalt hardens, embedding particles into a painted surface or embedding particles into a tarred or other coated surface. In each case, the kinds of particles used preferably are chosen based on the functional and/or aesthetic effects that are intended to be achieved.

Also, in the embodiments described above, the blade assembly or agitator, as well as the corresponding motor, is attached to the bottom of the container 10. However, in alternate embodiments the blade assembly or agitator, together with its motor or other actuating mechanism, is attached to the cover of the container 10. In such embodiments, when the cover is placed on top of container 10, the blade assembly or agitator preferably extends deeply into (e.g., close to the bottom of) container 10, thereby causing a similar agitation effect. One advantage of such embodiments is that it can be relatively easy to clean or otherwise maintain the blade assembly or agitator, even when the container 10 remains full of particles, by simply removing the cover and lifting the blade assembly or agitator out of the container 10.

Finally, in the embodiments described above, the vacuum hose 30 attaches near the top of container 10 so that the particles can be withdrawn while they remain airborne. However, in alternate embodiments, the hose 30 attaches to the bottom of container 10 and draws in particles as they settle on the bottom surface of container 10.

ADDITIONAL CONSIDERATIONS

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A method of spraying fibers, comprising:

obtaining a container having an agitator in its bottom section;

partially filling the container with fibers so as to at least partially cover the agitator;

operating the agitator with the container substantially closed, thereby causing a plurality of the fibers to become airborne within the container;

creating an airflow to draw the airborne fibers out of the container; and directing the airborne fibers that have been drawn out of the container into a desired spray, using a sprayer, wherein the fibers are sprayed onto at least one of (1) a shoe outsole and (2) a sheet of material that subsequently is cut into a shoe outsole.

2. A method according to claim 1, wherein the agitator comprises a blade assembly.

3. A method according to claim 2, wherein the blade assembly is completely submerged beneath the fibers when the fibers are at rest.

4. A method according to claim 2, wherein when the agitator is operated the blade assembly rotates at less than 40 revolutions per minute.

5. A method according to claim 2, wherein when the agitator is operated the blade assembly rotates at less than 120 revolutions per minute.

6. A method according to claim 1, wherein the agitator comprises a plurality of coaxial fans.

7. A method according to claim 1, further comprising a step of covering the container to create a substantially airtight chamber within the container, after the container has been partially filled with the fibers.

8. A method according to claim 1, wherein the airborne fibers are drawn out of the container using an air suction hose.

9. A method according to claim 8, further comprising at least one of a mesh filter and a rotating blade structure between the container and the air suction hose.

10. A method according to claim 1, wherein the fibers are approximately 1-2 millimeters in length.

11. A method according to claim 1, wherein the fibers are made of a natural material.

12. A method according to claim 1, wherein the fibers are sprayed onto an adhesive-coated surface.

13. A method according to claim 12, further comprising a step of collecting the fibers that do not adhere to the surface and pouring the collected fibers back into the container for reuse.

14. A method according to claim 1, wherein the sprayer includes a distal end at which the airborne fibers exit, and wherein the sprayer is provided with a supplemental high-pressure air jet, at significantly higher pressure than the air otherwise exiting from the sprayer, that is close to the distal end of the sprayer and conducts airflow toward the distal end of the sprayer.

15. A method of spraying fibers, comprising:

obtaining a container having a blade assembly in its bottom section;

partially filling the container with fibers so as to at least partially cover the blade assembly;

rotating the blade assembly with the container substantially closed, thereby causing a plurality of the fibers to become airborne within the container;

creating an airflow to draw the airborne fibers out of the container; and directing the airborne fibers that have been drawn out of the container into a desired spray, using a sprayer, wherein the fibers are sprayed onto at least one of (1) a shoe outsole and (2) a sheet of material that subsequently is cut into a shoe outsole.

16. A method according to claim 15, wherein the airborne fibers are drawn out of the container using an air suction hose.

17. A method according to claim 15, wherein the fibers comprise short fibers.

18. A method according to claim 15, wherein the fibers are made of a natural material.

19. A method according to claim 15, wherein the fibers are sprayed onto an adhesive-coated surface.

* * * * *

UNITED STATES PATENT AND TRADEMARK OFFICE

CERTIFICATE OF CORRECTION

PATENT NO. : 7,846,493 B1
APPLICATION NO. : 11/866289
DATED : December 7, 2010
INVENTOR(S) : Anthony Cox It is certified that error appears in the above-identified patent and that said Letters Patent is hereby corrected as shown below:

Title Page
In item (73) on the first page of the patent, change the name of the assignee from "Dynasty Foorwear, Ltd." to --Dynasty Footwear, Ltd.--

Signed and Sealed this
Fifteenth Day of February, 2011

David J. Kappos

David J. Kappos
*Director of the United States Patent and Trademark Office*